United States Patent [19]

Breu

[11] 3,981,333

[45] Sept. 21, 1976

[54] VARIABLE TURN COIL WINDER

[75] Inventor: Dennis Ludwig Breu, Stillwater, Minn.

[73] Assignee: Sperry Rand Corporation, New York, N.Y.

[22] Filed: Nov. 24, 1975

[21] Appl. No.: 634,397

[52] U.S. Cl. ..... 140/1; 29/605; 140/92.1; 242/7.09

[51] Int. Cl.[2] ..... B21F 3/04

[58] Field of Search ..... 140/1, 92.1; 29/605; 242/7.09

[56] References Cited

UNITED STATES PATENTS

| | | | |
|---|---|---|---|
| 3,263,309 | 8/1966 | Carman et al. | 29/605 |
| 3,409,980 | 11/1968 | Lawless et al. | 29/605 |

*Primary Examiner*—Travis S. McGehee
*Attorney, Agent, or Firm*—William D. Bauer; Thomas J. Nikolai; Marshall M. Truex

[57] ABSTRACT

This invention relates to an apparatus facilitating the mechanized manufacture of intermediately tapped electrical transformers. The apparatus winds coils on open ferromagnetic bobbin-type cores automatically by winding wire around the bobbin cores, pulling the tap, if any, and securing the wires so that they will not unwind. The bobbins are manually loaded into a rotatable turret wheel which sequentially positions them in a work station. A motor driven bail engages the wire and causes the wire to be wrapped around the bobbin located at the work station a predetermined number of times. When the number is reached, a solenoid operated hook grasps the wire, pulls the wire away from the bobbin, forming a loop, and is rotated so as to twist the wire as the bail continues to cause a second predetermined number of turns to be wound on the bobbin. The twisting ultimately causes the wire loop between the first and second sets of windings to snap at the hook creating a winding tap. The turret then rotates to further stations which apply solvent to secure the wires, dry the solvent, separate the wound coils and remove the wound coils from the apparatus.

7 Claims, 2 Drawing Figures

VARIABLE TURN COIL WINDER

BACKGROUND OF THE INVENTION

The winding of intermediately tapped coils to form electrical transformers has long been either a slow, tedious and basically manual operation or an expensive mechanized operation utilizing highly sophisticated equipment. The manual operation consisted of insertion of a ferromagnetic bobbin on a motor-driven spindle, holding the wire around the bobbin and manually winding the coil by starting rotation of the spindle, counting the approximate number of turns and stopping the rotation, cutting the wire for the primary, winding the secondary by starting rotation of the spindle, counting the approximate number of turns and stopping the rotation, cutting the wire for the secondary, twisting the center tap wires together, applying solvent to secure the wires, allowing drying time for the solvent, and removing the finished coil from the spindle. The manual operation has been time consuming and inexact in the number of turns wound. One operator typically could not wind more than approximately 150 coils per day. The present invention speeds up the process with mechanization utilizing a simple device. One operator using the invention may now typically wind approximately 1,000 coils per day.

Other automatic coil winders have utilized winding means consisting of the stationary core and a rotatable winding head and have utilized a step-by-step rotatable turret mechanism and have utilized automatic coil turn holding means. Winding means utilizing the rotating winding head around a stationary core have been well known as is illustrated in U.S. Pat. No. 1,579,274 which issued on Aug. 29, 1924, and in U.S. Pat. No. 3,865,152 which issued on Feb. 11, 1975, and also U.S. Pat. No. 3,724,515 which issued on Apr. 3, 1973. The use of a step-by-step rotatable turret in conjunction with the stationary bobbin winding means is also well known as illustrated by U.S. Pat. No. 3,865,152 and U.S. Pat. No. 2,782,809 which issued on Feb. 26, 1957. Thus the method of winding coils on stationary bobbins utilizing a rotatable turret mechanism with the winding wire interconnecting adjacent bobbins has been well known for some time. Various methods of holding the coil turns together after the winding wire connecting adjacent coils has been severed have also been shown as is illustrated by U.S. Pat. No. 3,865,152 which issued on Feb. 11, 1975. However, none of these apparatus have utilized an automatic intermediate tap hook mechanism for pulling an intermediate center tap on the coil nor have they utilized the automatic turn securing mechanism consisting of adhesive coated wire in conjunction with the application of a solvent and means for drying that solvent.

The present invention provides a relatively simple, inexpensive, semi-automatic machine facilitating the manufacture of intermediately tapped electrical transformers in which ferromagnetic bobbin-type cores are wound with wire. In carrying out this invention, the only manual operation is the loading of empty bobbins into spring loaded collets affixed to a rotatable turret wheel. The turret then advances the collet to a winding station. A motorized winding head, utilizing a wire bail being fed with adhesive coated magnet wire, is revolved until a counting mechanism has exactly counted the proper number of turns in the primary which had been previously set. A movable hook mechanism then catches the wire. The winding head continues to revolve while the hook mechanism is retracted and then is rotated at a relatively high speed twisting the wire until it breaks in the hook mechanism, thereby creating a finished tap. The said winding head continues to revolve until another counting mechanism has exactly counted the proper number of turns in the secondary which had been previously set and which may be different from the first count. The motorized winding head is then dynamically braked to a stop. The turret then advances, passing the wound coil through a solvent activating the adhesive coating on the wire and further advancing the wound coil through a flow of air, thereby expediting the drying of the solvent and adhesive and securing the wires. The turret then advances the wound coil past a solenoid activated cutter blade which, at the proper time, severs the wire, thereby separating the wound coil from the feed wire. The turret then advances the wound coil to a removal station where a mechanical cam releases the spring loaded collet and an electromagnet attracts the wound coil and extracts it from the collet and allows the wound coil to drop into a holding bin when the electromagnet is deactivated. The turret again advances, returning the collet to the loading station where the process then starts anew. The turret includes a plurality of such collets allowing a plurality of bobbins to be processed simultaneously, each at a different step of manufacture.

OBJECT

It is accordingly the object of the present invention to provide a relatively simple, inexpensive, semi-automatic machine to facilitate the manufacture of miniature electrical transformers in which ferromagnetic bobbins are wound with wire.

DESCRIPTION OF THE DRAWINGS

The foregoing object, advantages, construction and operation of the present invention will become more readily apparent from the following description and accompanying drawing in which.

DESCRIPTION OF THE PREFERRED EMBODIMENT

Figure 2:
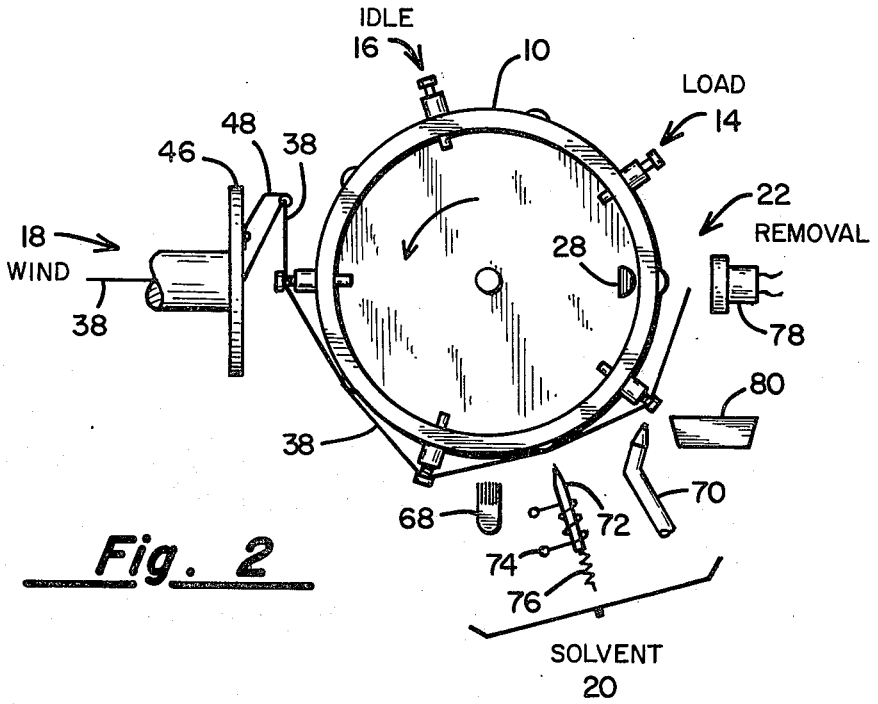
FIG. 2 is a side view of the variable turn coil winder partially cut away.

Referring first to FIG. 2, there is a rotatable turret wheel 10 on the periphery of which are located a plurality of spring loaded collets 12. The turret wheel 10 and spring loaded collets 12 are part of the mechanism which provides for the securing and advancing open ferromagnetic bobbin cores 24. Each of the collet positions around the turret 10 represents a work station. As shown in FIG. 2, these work stations are represented as a load station 14, an idle station 16, a wind station 18, a solvent station 20 and a removal station 22. In this particular embodiment there are five collets 12 and five work stations (14–22); however, the exact number of collets and work stations may be more or less, depending upon the multiplicity of functions performed at each station.

Into each collet 12 is inserted a ferromagnetic bobbin core 24. Each ferromagnetic bobbin core 24 is cylindrical in shape with its height greater than its diameter. The middle or central portion of the cylinder along its axis is of a smaller diameter than the end portions of the cylinder. Each bobbin is approximately 0.090 inch in height and 0.030–0.060 inch in diameter. The spring loaded collet 12 holds the bobbin 24 in place while the turret 10 rotates, advancing the bobbin 24 through the various work stations 14 through 22. Each spring loaded collet 12 may be released to provide for the insertion and removal of bobbins 24 by either a manual collet release lever 26 located near the load station 14 or a mechanical collet release cam 28 located near the removal station 22. Also connected to the collet release lever 26 is an inhibit microswitch 30 which prevents further turret 10 rotation until the manual bobbin load operation is complete.

Figure 1:
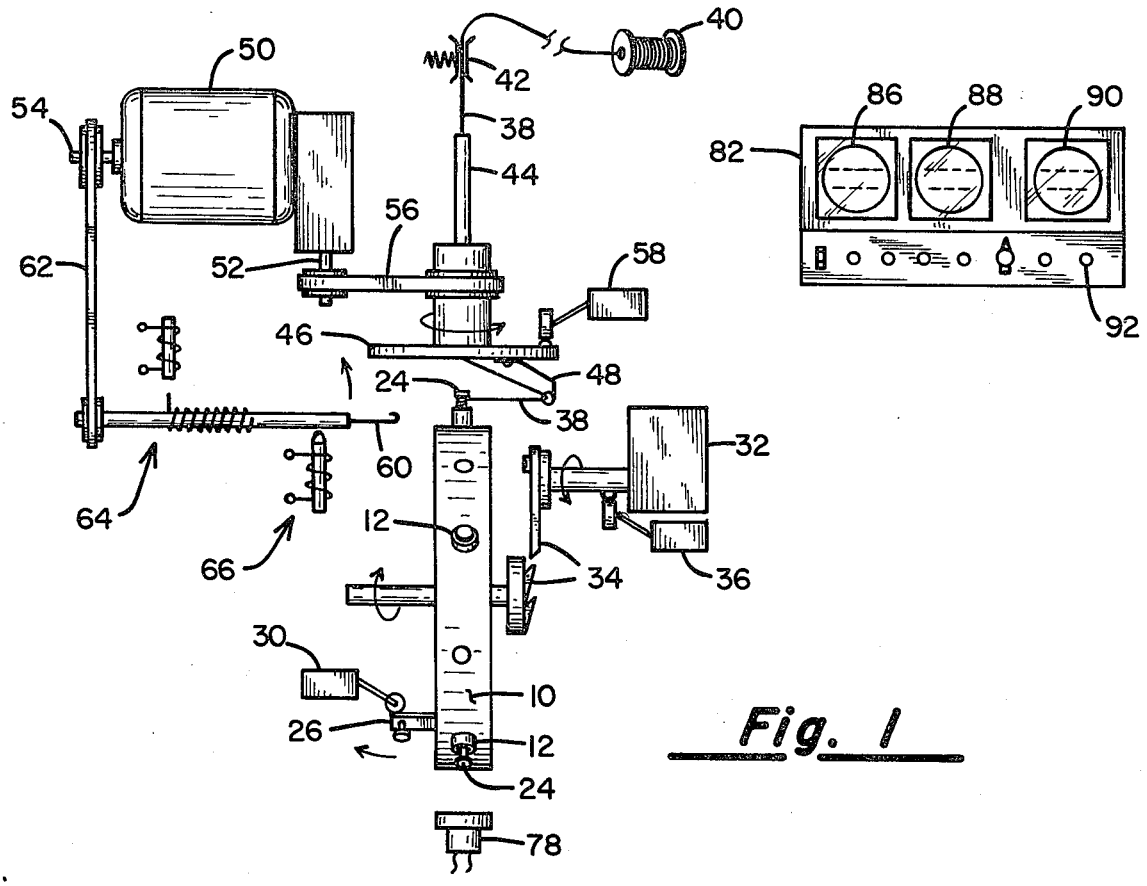
FIG. 1 is a top plan view of the variable turn coil winder.

Referring now to FIG. 1 which shows in schematic form the top view of the invention, a means is provided for automatic incremental turret rotation for advancing the bobbins 24 from work station to work station. Specifically, a turret motor 32 drives a ratchet arm 34 which rotates the turret 10 until the turret limit switch 36 senses that the bobbin 24 has advanced to the next work station at which time the turret limit switch 36 deactivates the turret motor 32.

Near the wind station 18 adhesive coated magnet wire 38 is provided from a wire supply device 40, in this case a wire spool, through a wire tension device 42, to a stationary wire feed tube 44 to a winding head 46. Incorporated in the winding head 46 is a wire bail 48 which serves to position the magnet wire 38 correctly so that the magnet wire 38 will wrap around the bobbin 24 when the winding head 46 is rotated. The winding head 46 is driven by a drive motor 50 containing both a low speed shaft 52 and a high speed shaft 54. The low speed shaft 52 of the drive motor 50 is connected to the winding head 46 by means of the low speed drive belt 56. Also incorporated at the winding head 46 is the turn count microswitch 58 which serves as a sensor so that the drive motor 50 may be activated and deactivated based on the number of turns completed.

To the side of the turret 10, at approximately a right angle from the winding head 46, as shown in FIG. 1, is located a movable hook mechanism which provides a mechanism for creating at least one intermediate tap. The movable hook mechanism consists of a tap hook 60 in conjunction with a tap hook solenoid 66, an electrically operated spring clutch 64 and a rotational drive mechanism. The tap hook 60 is driven in rotation from the high speed shaft 54 of the drive motor 50 by means of the high speed drive belt 62 connected through a spring clutch 64. Also positioned near the tap hook 60 is the tap hook solenoid 66. When the tap hook solenoid 66 is not activated, the tap hook 60 will be located out of the path of the winding wire 38 as determined by the path of the wire bail 48 as the winding head 46 rotates. The tap hook, in this instance, will be located just in front of the said winding path as viewed by FIG. 1, the top plan view. When the tap hook solenoid 66 is activated, the tap hook 60 is forced rearward, as shown in FIG. 1, so that it is placed within the said winding path of the winding wire 38. In this position the tap hook 60 will intercept and catch the winding wire 38 upon the next revolution of the winding head 46.

A solvent saturated brush 68 is located within the path of a bobbin 24 as it passes from the wind station 18 to the solvent station 20 as shown in FIG. 2. This solvent brush is saturated with alcohol or other suitable solvent so that it will be deposited on the wound bobbin 24 as it passes the solvent brush 68. An air jet 70 is located at the solvent station 20 to provide a flow of air across the wound bobbin 24 to expedite the hardening and evaporation of the solvent applied by the solvent brush 68. The solvent reacts with the adhesive coated magnet wire activating the adhesive and, when dry, causes the wire wraps to be secured together preventing any unwinding after removal from the invention.

Located at the removal station 22 is a cutter blade 72 activated by a cutter solenoid 74. When activated, the cutter solenoid 74 causes the cutter blade 72 to sever the magnet wire 38 still connecting the wound bobbin 24 located at the removal station 22 from the next wound bobbin 24 located at the solvent station 20. As soon as the cutter solenoid 74 is deactivated, the cutter blade 72 returns to its original position by means of the cutter return spring 76.

As shown in FIG. 2, an electromagnet 78 is provided. The electromagnet 78 is activated when the wound bobbin 24 is positioned directly in front of it and after the wound bobbin 24 has passed the collet release cam 28 located between the cutter blade 72 and the electromagnet 78 causing the collet 12 to release the wound bobbin 24. The electromagnet 78 then extracts the wound coil 24 from the collet 12 by electromagnetic attraction. When the electromagnet 78 is then deactivated, gravity causes the wound bobbin 24 to fall into a holding bin 80.

As shown in FIG. 1, an electronic controller 82 is provided so that the operator may set and control the number of turns in the primary of the transformer, whether a center tap is to be provided and the number of turns in the secondary of the transformer. The controller 82 senses signals from the inhibit microswitch 30, the turret limit switch 36, the turn count microswitch 58, a start switch 84, a tap switch 92 and three manually presettable counters: a primary counter 86; a tap counter 88 and a secondary counter 90. The controller 82 also provides sequencing and controls for the turret motor 32, the drive motor 50, the spring clutch 64, the tap hook solenoid 66, the cutter solenoid 74 and the electromagnet 78. The three counters (86, 88 and 90) provide the operator with control over the number of turns in the primary of the transformer and the number of turns in the secondary of the transformer. The operation of these counters can best be illustrated by a specific example.

Assume that a transformer is desired with three turns in the primary, a center tap and 15 turns in the secondary. The primary counter 86 should be set to three, indicating the three turns of the primary. The tap counter 88 should be set to two to indicate the tap hook 60 should be retracted during the fourth turn and the secondary counter 90 should be set to 15, indicating the number of turns of the secondary. As the bobbin 24 begins to be wound, the primary counter 86 is enabled while both the tap counter 88 and the secondary counter 90 remain disabled. This counter detects the number of revolutions of the winding head 48 via the turn count microswitch 58. Upon the beginning of the third revolution of the winding head 48, the primary counter 86, which has been previously set to three, enables both the tap counter 88 and the secondary counter 90 and creates a signal which deactivates the spring clutch 64 and activates the tap hook solenoid 66. Thus, on this revolution of the winding head 48, the third revolution, the tap hook 60 will engage the magnet wire 38 and begin to pull the tap. Approximately five-eighths of the way through the fourth revolution the tap counter 88, which has previously been set to two, will create a signal which will activate the spring clutch 64 and deactivate the tap hook solenoid 66. Hence, the tap hook 60 will be drawn out of the path of the magnet wire 38 on this fourth revolution of the winding head 48 or the first turn in the secondary of the transformer.

The winding head 48 will continue to operate until the secondary counter 90, which has been previously set to 15, senses the completion of the eighteenth revolution, completing the 15 turns of the secondary of the transformer. In addition, a tap switch 92 is provided on the controller 82 which, when activated, will disable the tap counter 88 and secondary counter 90, thereby creating a transformer with no center tap. A start switch 84 is also provided on the controller 82 and when activated commences the automatic sequencing of the invention.

Now that the apparatus has been described in detail, consideration will be given to the details of the operation of the invention. The operating sequence is as follows:

1. Prior to the automatic operation of the invention, two initital set-up steps must be performed manually by the operator. First, empty ferromagnetic bobbins 24 must be loaded into the collets 12 at the load station 14, the idle station 16 and the wind station 18. Second, magnet wire 38 must be fed from the wire supply device 40 through the wire tension device 42 and the wire feed tube 44 to the wire bail 48 of the winding head 46. The magnet wire 38 and the wire bail 48 are then positioned so that when the winding head 46 is rotated, the magnet wire 38 will fall over the bobbin 24 located at the wind station 18. Note that these are initial start-up procedures only. During automatic sequencing, bobbins 24 will already exist in the collets 12 located at the idle station 16 and the wind station 18 and the magnet wire 38 and wire bail 48 will automatically be correctly positioned. Operation of a start switch located on the controller 82 then activates the automatic sequencing.

2. The operator performs the manual load operation by operating the collet release lever 26 at the load station 14 and inserting an empty ferromagnetic bobbin 24 into the collet 12 at that location. The inhibit microswitch 30 prevents further sequencing until that operation is complete. Note that after start-up this is the only manual operation required.

3. The turret 10 then advances the bobbin 24 from the load station 14 to the idle station 16 and then to the wind station 18. After the said bobbin 24 reaches the wind station 18, the drive motor 50 begins operation causing both the winding head 46 and the tap hook 60 to rotate. As the winding head revolves, magnet wire 38 is wrapped around the said bobbin 24 forming the primary of the transformer. The turn count microswitch 58 senses the number of revolutions of the winding head 46. When the proper number of turns on the primary are wound, the controller 82 causes the spring clutch 64 to be deactivated and the tap hook solenoid 66 to be activated. This causes the tap hook 60 to be stationary and to be located in the path of the magnet wire 38 on the next revolution of the winding head 46. The tap hook 60 then catches the magnet wire 38 and the spring clutch 64 is activated and the tap hook solenoid 66 is deactivated. This causes the tap hook 60 to spin rapidly, twisting the center tap wires together, causing the loop to break, thus forming a completed center tap. The turn count microswitch 58 then senses the number of revolutions of the winding head 46 and causes the controller 82 to dynamically brake the drive motor 50 to a stop when the proper number of turns in the secondary is reached. This completes the actual winding operation on the bobbin 24.

4. Following completion of the wind operation the turret 10 again advances, moving the wound bobbin 24 from the wind station 18 to the solvent station 20. As the said wound bobbin 24 moves, it passes through the solvent brush 68. The solvent imparted to the said wound bobbin 24 reacts with the adhesive coating of the magnet wire 38, causing the multiple turns of the magnet wire 38 to adhere to each other. As the said wound bobbin 24 reaches the solvent station 20, an air flow from the air jet 70 expedites the hardening and evaporation of the solvent. This operation prevents the said wound bobbin 24 from unwinding during further operations and after removal from the invention.

5. The turret 10 is again stepped and advances the said wound bobbin 24 from the solvent station 20 to the separate station 22. After the advancement, the cutter solenoid 74 is activated, causing the cutter blade 72 to intersect the magnet wire 38 still connecting the wound bobbin 24 located at the separate station 22 with the next wound bobbin 24 located at the solvent station 20. The cutter blade 72 severs the magnet wire 38 and as the cutter solenoid 74 is deactivated, the cutter return spring 76 causes the cutter blade to return to its original position, having separated the said wound bobbin 24 from the next wound bobbin 24.

6. The turret 10 again advances in a stepwise fashion moving the said wound bobbin 24 from the separate station 22 toward the load station 14. As the collet 12, holding the wound bobbin 24, passes the collet release cam 28, the collet 12 is opened. Simultaneously, the electromagnet 78 is activated, attracting the wound bobbin 24 and extracting it from the collet 12. The electromagnet is then deactivated and the wound bobbin 24 falls into the holding bin 80 and the manufacture is complete.

7. The entire sequence is now repeated, starting with the manual load operation described in step 2 above.

Thus, it can be seen that there has been shown and described a novel apparatus facilitating the manufacture of miniature electrical transformers. It is to be understood, however, that various changes, modifications and substitutions in the form and details of the described apparatus can be made by those skilled in the art without departing from the scope of the invention as defined by the following claims.

What is claimed is:

1. Apparatus for facilitating the winding of intermediately tapped electrical transformers utilizing open ferromagnetic bobbin-type cores comprising:

a. means for securing a plurality of bobbins and advancing said bobbins individually to a plurality of work stations;

b. winding means located at one of said plurality of work stations for winding each stationary bobbin core individually, with first and second groups of turns of wire, and c. means for creating at least one intermediate tap between said first and second groups of turns by pulling the wire being wound on the bobbin core a predetermined distance away from the bobbin core upon the completion of the winding of said first group of turns and twisting the wire so withdrawn while said means for winding is applying said second group of turns to said bobbin core, the arrangement being such that the twisting ultimately exceeds the elastic limit of said wire.

2. Apparatus as in claim 1 wherein the securing and advancing means comprises:

a. a rotatable turret wheel on the periphery of which is located a plurality of spring loaded collets, and b. means for incrementally rotating the turret so that, during each incremental step of rotation, each collet is advanced from one work station to the next work station.

3. Apparatus as in claim 2 wherein the means for creating at least one intermediate tap comprises:

a. a movable hook mechanism having a u-shaped hook at one end thereof positioned with respect to said winding means so as to be capable of intercepting the winding wire when moved into the winding path and continuing to hold said wire when it is moved out of said winding path;

b. means for moving the hook mechanism in and out of said winding path, and c. means for causing rapid rotation of said hook mechanism.

4. Apparatus as in claim 3 wherein the means for moving the hook mechanism in and out of said winding path comprises a solenoid mechanism connected to said movable hook mechanism operative to selectively position said hooked end of said hook mechanism in the path of said winding wire causing said hooked end of said hook mechanism to intercept the path of the winding wire.

5. Apparatus as in claim 3 wherein the means for causing rotation of the hook mechanism comprises:

a. a rotational drive mechanism, and b. an electrically operated spring clutch coupled to said rotational drive mechanism capable of disconnecting said hook mechanism from said rotational drive mechanism.

6. Apparatus as in claim 2 and further including:

a. use of adhesive coated wire as said winding wire;

b. means located at another of said plurality of work stations for activating the adhesive on said adhesive coated wire, and c. means for severing the winding wire linking adjacent wound bobbin cores and for individually removing said wound bobbin cores from said securing and advancing means.

7. Apparatus as in claim 6 wherein the adhesive activation means comprises:

a. a solvent saturated brush positioned in the path of travel of each wound bobbin core as said wound bobbin core advances via said securing and advancing means after said bobbin core has been wound and before said adjacent wound bobbin cores have been severed from each other, and b. an air jet located and positioned so that pressurized air from said air jet will pass over said wound bobbin cores after they have passed through said solvent brush and before said wound bobbin cores are separated from each other.

* * * * *